United States Patent [19]

Miller

[11] 4,144,919

[45] Mar. 20, 1979

[54] SAFETY WEDGE AND HANDLE

[76] Inventor: James B. Miller, 426 Polk St., River Rouge, Mich. 48218

[21] Appl. No.: 911,508

[22] Filed: Jun. 1, 1978

[51] Int. Cl.[2] ..... B25C 1/00; B25D 1/00; B25G 1/00

[52] U.S. Cl. ..... 145/61 R; 145/29 R

[58] Field of Search ..... 145/61 R, 29 R, 2 R

[56] References Cited

U.S. PATENT DOCUMENTS

| | | | |
|---|---|---|---|
| 1,565,668 | 12/1925 | Nicholls | 145/29 R |
| 4,089,356 | 5/1978 | O'Connor | 145/29 R |

FOREIGN PATENT DOCUMENTS

| | | | |
|---|---|---|---|
| 996400 | 6/1965 | United Kingdom | 145/29 R |

*Primary Examiner*—James L. Jones, Jr.
*Assistant Examiner*—J. T. Zatarga

[57] ABSTRACT

A handle and wedge assembly, for use with a hammerhead, to make a manually operated hammer; the wedge including two flat opposite sides tapering toward a point, and each flat side having a raised, transverse extending bulge, while the handle includes a conventional slit on one end, so as to form a slot into which the wedge fits, and the slot having a transverse extending lock groove, into which the raised bulge of the wedge snap fits, so as to prevent the wedge working itself loose, and out of the handle.

1 Claim, 5 Drawing Figures

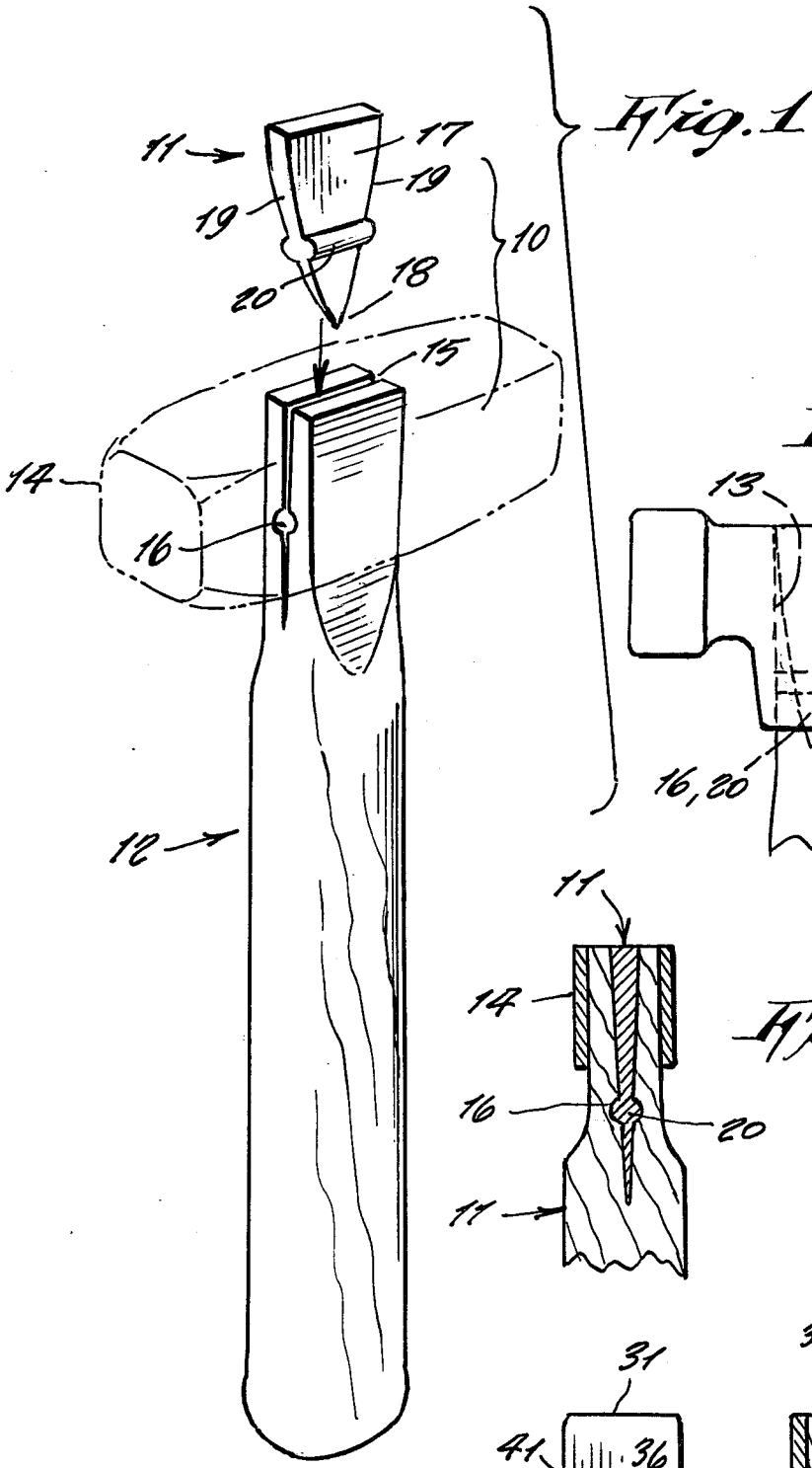
Fig. 1
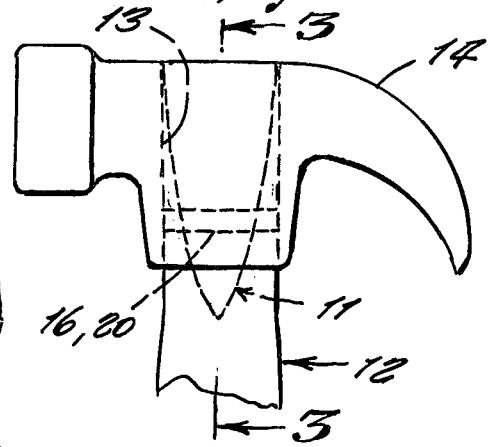
Fig. 2
Fig. 3
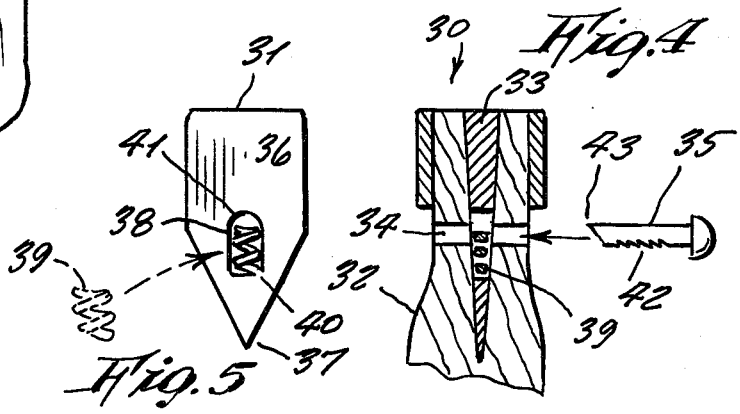
Fig. 4
Fig. 5

SAFETY WEDGE AND HANDLE

This invention relates generally to hand-held hammers.

It is generally well known, that a hammer fitted with a conventional wedge, will, in time, with continued use, cause the wedge to become loosened, so as to work itself out, and thus cause the hammerhead to fly off the handle. This situation is, of course, objectionable, and is, therefore, in want of an improvement.

Accordingly, it is the principal object of the present invention to provide a handle and wedge assembly for a hand-held hammer, and which incorporates a locking means, so as to prevent the wedge from becoming loosened within the handle, in order to prevent the hammerhead from flying off.

Another object of the present invention is to provide a wedge and handle assembly, wherein the wedge includes a bulge on each side thereof, which snap-fits into a transverse extending lock groove formed in the slot on the handle and, so as to firmly lock the wedge within the handle, and prevent hammer blow vibrations from loosening the same.

Yet a further object is to provide a wedge and handle assembly, which is readily adaptable for other hand-held tools besides a hammer, such as an axe, a pick, an adze, or other tools wherein a metal head is held upon an end of a wooden handle.

Other objects are to provide a wedge and handle assembly, which is simple in design inexpensive to manufacture, rugged in construction, easy to use and efficient in operation.

These, and other objects, will be readily evident, upon a study of the following specification and the accompanying drawing, wherein:

FIG. 1 is a perspective view of the invention components in position for assembly with a hammerhead;

FIG. 2 is a side view of the assembled hammer, shown incorporating the present invention;

FIG. 3 is a cross-sectional view, taken on line 3—3 of FIG. 2;

FIG. 4 is a view similar to FIG. 3, and showing a modified design of the invention, and FIG. 5 is a side view of a wedge used in the structure illustrated in FIG. 4.

Referring now to the drawing in greater detail, and more particularly to FIGS. 1, 2 and 3 thereof at this time, the reference numeral 10 represents a wedge and handle assembly, according to the present invention, and which includes a wedge 11 and a handle 12.

The handle is made of hard wood, such as hickory or the like, and which, on one end, is shaped in order to fit inside a hole 13 of a hammerhead 14. This end of the handle is provided with a slot 15, for the purpose of receiving the wedge 11. Intermediate the opposite ends of the slot 15, there is a transverse extending groove 16, formed in each side wall of the slot, the groove being circular in cross-section, formed by a generally semi-circular recess in each of the slots sidewalls.

The wedge 11 comprises a generally flat member, having generally flat opposite side faces 17, which taper toward a point 18. Opposite side edges 19 of the wedge likewise taper toward the point 18. In the present invention, a transverse extending bulge 20, upon each opposite side face 17, form a generally circular cross-sectional configuration, that conforms to the shape of the groove 16, so that when the wedge is driven into the slot 15, the bulges snap-fit into the groove, in order to permanently lock the wedge therein, and prevent accidentally working itself loose, and the hammerhead from flying off.

In a modified design of the invention, shown in FIGS. 4 and 5, there is a wedge and handle assembly 30, that includes wedge 31 and handle 32. The handle includes a slot 33, into which the wedge 31 fits. The handle, in addition, includes a cross-sectionally circular opening 34, extending transversely therethrough, at right angle to the plane of the slot 33, for the purpose of receiving a fastener 35.

The wedge 31 includes the opposite side faces 36, that taper to a point 37, and the wedge includes an elongated groove 38 transversely therethrough, within which a compression coil spring 39 is permanently secured, by means of a weld 40, joining one end of the spring with one end of the slot 38. The opposite end of the slot is rounded, as shown at 41, so as to generally accommodate the cross-sectional configuration of the fastener 35. In this design, when the wedge is driven into the handle, as shown in FIG. 4, the fastener is then inserted into the opening 34, so that it bears downwardly against the spring 39, and causes the same to force the wedge inwardly, deeper into the handle. Thus, if the wedge becomes loose, it will sink deeper into the wooden handle. Teeth 42, along the side of the fastener, serve to grasp the end of the spring 39, so as to prevent the fastener from becoming loose. The tip 43 of the fastener is pointed, for the purpose of easy insertion, and compressing the spring 39 as it is installed.

Thus, a modified design is provided.

While various changes may be made in the detail construction, it is understood that such changes will be within the spirit and scope of the present invention, as is defined by the appended claims.

What I now claim is:

1. A wedge and handle assembly for a hand-held tool that includes a head installed upon an end of a handle of said assembly; said assembly also including a wedge fitted in a slot in said end of said handle, and means for preventing said wedge from vibrating loose, and working out of said slot of said handle; said means comprising a slot through said wedge having a compression coil spring in a lower end thereof, a transverse extending opening through said handle and a fastener received through said handle opening and bearing against said spring of said wedge.

* * * * *